US006925940B2

(12) United States Patent
Ruban

(10) Patent No.: US 6,925,940 B2
(45) Date of Patent: Aug. 9, 2005

(54) TAMPING TINE FOR A TAMPING UNIT

(75) Inventor: Anatolij Ruban, Dlinnaja (RU)

(73) Assignee: Franz Plasser Bahnbaumaschinen Industriegesellschaft mbH, Vienna (AT)

( * ) Notice: Subject to any disclaimer, the term of this patent is extended or adjusted under 35 U.S.C. 154(b) by 0 days.

(21) Appl. No.: 10/610,185

(22) Filed: Jun. 30, 2003

(65) Prior Publication Data

US 2004/0045473 A1 Mar. 11, 2004

(30) Foreign Application Priority Data

Jun. 28, 2002 (AT) ..... GM424/2002

(51) Int. Cl.[7] ..... E01B 27/00

(52) U.S. Cl. ..... 104/10; 172/713; 37/447; 404/133.05

(58) Field of Search ..... 104/12, 2, 13, 104/10, 7.1, 133.05; 404/133.05; 37/447; 172/719, 713, 772, 772.5

(56) References Cited

U.S. PATENT DOCUMENTS 1,260,603 A * 3/1918 Vaughan ..... 104/13
4,315,464 A * 2/1982 Borden ..... 104/10
4,903,609 A * 2/1990 Isakov et al. ..... 104/10
4,922,828 A * 5/1990 Theurer et al. ..... 104/10
4,996,925 A * 3/1991 Biermann ..... 104/10
5,261,763 A * 11/1993 Crowell ..... 404/133.05
5,609,533 A * 3/1997 Wheeler ..... 473/408
2002/0051682 A1 * 5/2002 Gevik et al. ..... 404/133.05

FOREIGN PATENT DOCUMENTS

WO 87/03316 6/1987

* cited by examiner

*Primary Examiner*—Frantz F. Jules
(74) *Attorney, Agent, or Firm*—Laurence A. Greenberg; Werner H. Stemer; Ralph E. Locher

(57) ABSTRACT

A tamping tine for tamping ballast underneath a railroad track has a tine shank and a tine pad attached to the shank. For increasing its abrasion resistance, the tine pad is formed with a pad casing of wear-resistant material. The pad casing is formed with an opening and it is filled with core material. The core material is suitable for welding to the tine shank and it is attached thereto by way of a welding seam.

4 Claims, 2 Drawing Sheets

FIG. 1
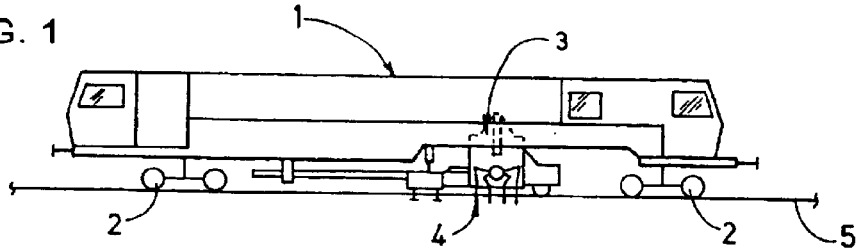
FIG. 2
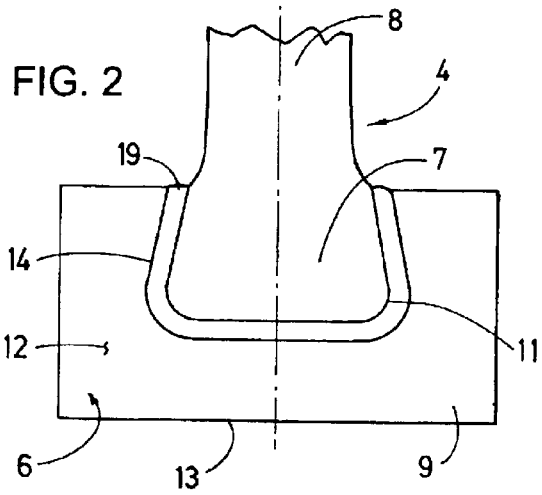
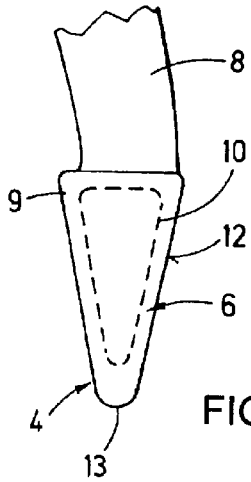
FIG. 3
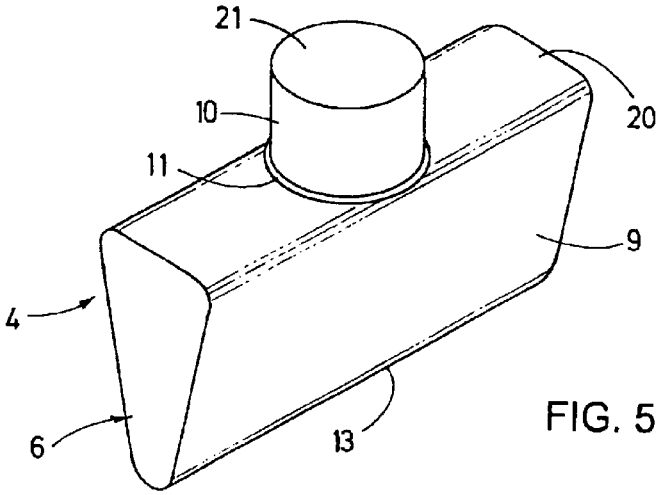
FIG. 5

TAMPING TINE FOR A TAMPING UNIT

BACKGROUND OF THE INVENTION

1. Field of the Invention

The present invention relates, in general, to a tamping tine for a tamping unit of a tamping machine for tamping ballast underneath a railroad track. The invention also relates to a method of producing a tamping tine for tamping ballast underneath a railroad track.

2. Description of the Related Art

U.S. Pat. No. 4,996,925 to Biermann describes a tamping tine of this type. The tine, referred to as a tamping tool in the patent, is provided with a tine pad in the shape of a pad casing adapted to be slipped onto a tine shank. To establish an adequate connection between the pad casing and tine shank, an intermediate layer between the shank and the casing is compressed accordingly. Such a solution has the drawback that the quality of the connection between the pad casing and tine shank depends entirely upon the compressive forces.

SUMMARY OF THE INVENTION

It is accordingly an object of the invention to provide a tamping tine and a corresponding manufacturing method which overcome the above-mentioned disadvantages of the heretofore-known devices and methods of this general type and which provide for an improved tamping tine which, while offering high abrasion resistance, allows longer lasting use in operation.

With the foregoing and other objects in view there is provided, in accordance with the invention, a tamping tine for a tamping unit of a tamping machine for tamping ballast underneath a railroad track. The novel tine comprises:

a tine shank having a lower end;

a tine pad formed with a pad casing of wear-resistant material for increased abrasion resistance, the pad casing having an opening formed therein, and core material filled in the opening, the core material being suitable for welding to the tine shank; and a weld seam connecting the lower end of the tine shank to the tine pad.

A tamping tine configured in this way affords the particular advantage of exhibiting both high strength and optimal resistance to abrasion. Furthermore, the pad casing may advantageously be cast so as to have uniform thickness throughout, thus avoiding topical concentrations of material which might be vulnerable to impact. When renewing a tine pad that has become unusable due to long-time wear, an additional advantage results from the fact that the entire tine pad may be disconnected from the shank along the welding seam. Thus, the tine shank can be reused after a new tine pad has been welded to it.

In accordance with an added feature of the invention, the tine pad has a rear side and a bottom edge, and the opening is designed with a recess arranged at the rear side and leading towards the bottom edge. According to yet another feature, the core matter is designed to protrude from the opening in the pad casing, thus forming a shank stub.

With the above and other objects in view there is also provided, in accordance with the invention, a method of producing a tine pad for a tamping tine for tamping ballast underneath a railroad track. The method comprises the steps of casting a pad casing of wear-resistant steel, the pad casing having an opening; and filling the pad casing with a core matter, i.e., core material, thus closing off the opening while forming a contact surface.

In accordance with a concomitant aspect of the invention, there is provided a method of producing a tamping tine for tamping ballast underneath a railroad track which comprises the following steps: casting a pad casing of wear-resistant steel, the pad casing having an opening; filling the pad casing with a core matter, thus closing off the opening while forming a contact surface; and welding a rim zone of the core matter to a rim zone of a tine shank.

Other features which are considered as characteristic for the invention are set forth in the appended claims.

Although the invention is illustrated and described herein as embodied in a tamping tine for a tamping unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a schematic side view of a tamping machine having a tamping unit with a tamping tine according to the invention;

FIG. 2 is a rear elevational view of a lower segment of the tamping tine;

FIG. 3 is a side elevational view of the lower segment of the tamping tine;

FIG. 5 is a perspective view of an alternative embodiment of a tine pad according to the invention.

DESCRIPTION OF THE PREFERRED EMBODIMENTS

Figure 4:
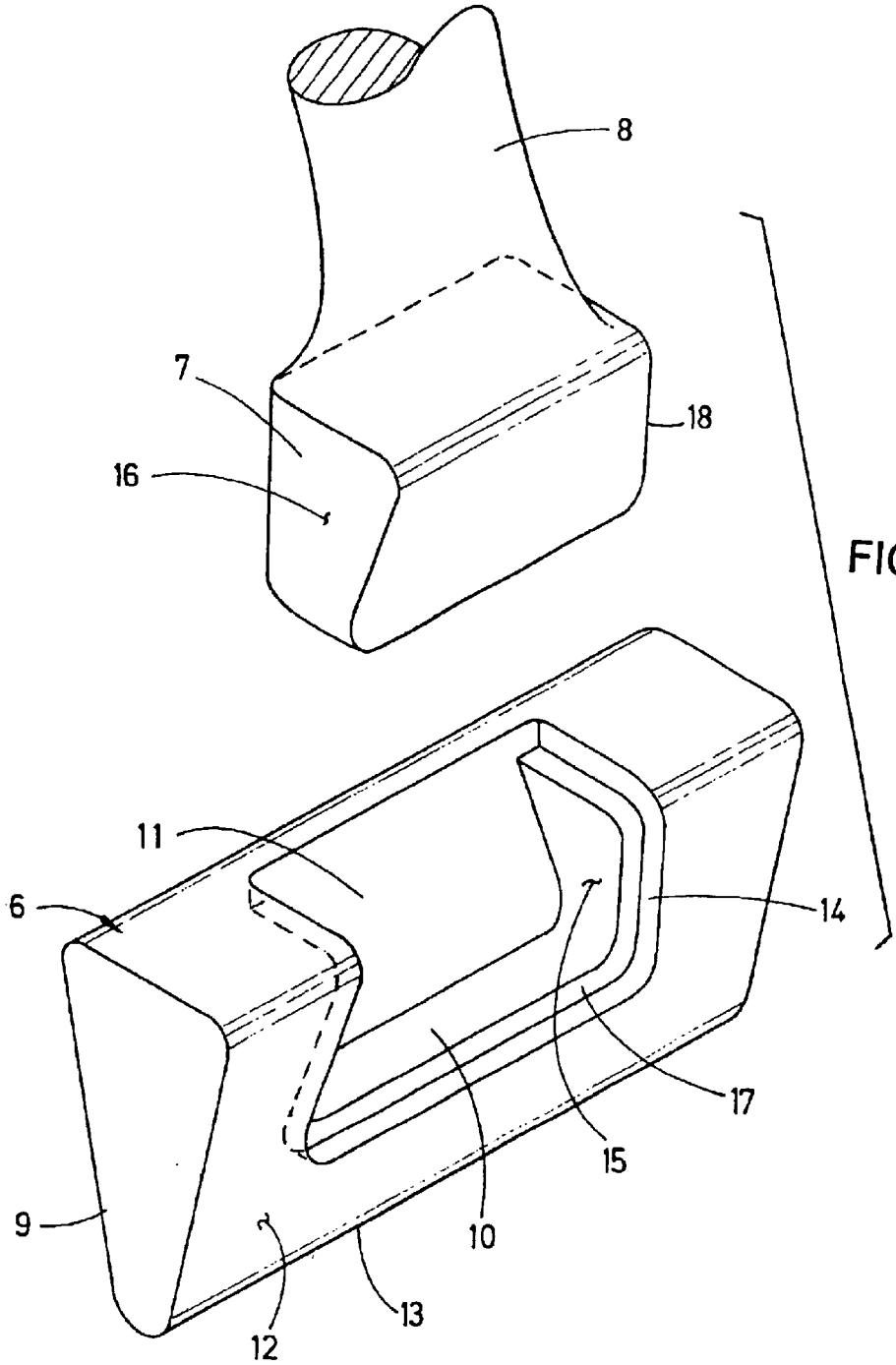
FIG. 4 is a perspective view of the tamping tine, showing the tine pad separated from the tine shank.

Referring now to the figures of the drawing in detail and first, particularly, to FIG. 1 thereof, there is shown a tamping machine 1 that is supported on undercarriages 2 or bogies on a track 5. A vertically movable tamping unit 3 for tamping ballast underneath the track 5 is disposed between the undercarriages 2. The tamping unit 3 is equipped with tamping tines 4, which will be described in more detail below.

With reference to the further FIGS. 2, 3 and 4, the tamping tine 4 comprises a tine pad 6 to is connected to a lower end 7 of a tine shank 8. In order to increase the resistance to abrasion, the tine pad 6 is composed of a pad casing 9, made of wear-resistant material, for instance steel. The casing 9 is filled by a core material or core matter 10 that is cast into the casing 9. The welding characteristic of the core matter 10 corresponds to that of the tine shank 8.

The tamping tine 4, or rather the tine pad 6, has a rear side 12 and a bottom edge 13. The pad casing 9 is formed with an opening 11 which, at the rear side 12, includes a recess 14 that leads down towards the bottom edge 13 of the tine. The core matter 10 cast into the casing 9 forms a contact surface 15. The lower end 7 of the tine shank 8 is configured with a contact surface 16 conforming in shape and size to the recess 14 and the contact surface 15.

During the process of producing a tamping tine 4, first the pad casing 9 is cast of wear-resistant steel. Thereafter, the hollow pad casing 9 is filled up with the core matter 10 which is cast into the casing, thus forming the contact surface 15 which closes off the opening 11 (see FIG. 4). The tine pad 6 is slipped or mounted onto the lower end 7 of the tine shank 8 in such a way that the two mating contact surfaces 15 and 16 come to lie immediately adjacent one another. Subsequently, a rim zone 17 of the contact surface 15 is welded to a rim zone 18 of the contact surface 16, thus producing a weld seam 19.

Referring now to FIG. 5, in a variant embodiment of a tine pad 6, the opening 11 is confined to a top edge or top surface 20 of the pad casing 9, positioned opposite to the bottom edge 13 of the tine 4. In this exemplary embodiment, the opening 11 is approximately circular in shape. A shank stub 21 of the core matter 10 cast into the pad casing 9 protrudes from the circular opening 11. In the process of manufacturing the tamping tine 4, the shank stub 21 is subsequently welded to a lower end of a tine shank 8, which has the same cross-section as the stub 21.

While the invention has been illustrated and described as embodied in a tamping tine for a tamping unit of a tamping machine, it is not intended to be limited to the details shown since various modifications and structural changes may be made without departing in any way from the spirit of the present invention.

I claim:

1. A tamping tine for a tamping unit of a tamping machine for tamping ballast underneath a railroad track, comprising:

a tine shank having a lower end;

a tine pad formed with a pad casing of wear-resistant material for increased abrasion resistance, the pad casing having an opening formed therein, and core material cast into said opening, said core material being suitable for welding to said tine shank; and a weld seam connecting said lower end of said tine shank to said tine pad.

2. The tamping tine according to claim 1, wherein said tine pad has a rear side and a bottom edge, and said opening is formed with a recess arranged at said rear side and leading towards said bottom edge.

3. The tamping tine according to claim 1, wherein said core material protrudes from said opening in said pad casing, forming a shank stub.

4. A method of producing a tamping tine for tamping ballast underneath a railroad track, which comprises the following steps:

casting a pad casing of year-resistant steel with an opening;

filling the pad casing by casting core material into said opening of the pad casing, thereby closing off the opening and forming a contact surface; and welding a rim zone of the core material to a rim zone of a tine shank.

* * * * *